United States Patent [19]

Rothchild

[11] 4,431,011

[45] Feb. 14, 1984

[54] PROCESS FOR EXPANDING TOBACCO WITH WATER

[76] Inventor: Ronald D. Rothchild, 106 Rynda Rd., South Orange, N.J. 07079

[21] Appl. No.: 304,713

[22] Filed: Sep. 23, 1981

[51] Int. Cl.[3] ..... A24B 3/18

[52] U.S. Cl. ..... 131/296

[58] Field of Search ..... 131/296, 303

[56] References Cited

U.S. PATENT DOCUMENTS 3,982,550 9/1976 de la Burcle et al. ..... 131/296

FOREIGN PATENT DOCUMENTS 29588 6/1981 European Pat. Off. ..... 131/296

*Primary Examiner*—V. Millin

*Attorney, Agent, or Firm*—Hopgood, Calimafde, Kalil, Blaustein & Judlowe

[57] ABSTRACT

The present invention relates to a method for increasing the filling power of tobacco by intense convection heating of moistened, and possibly frozen, tobacco in a gas with steam as its major component.

11 Claims, No Drawings

PROCESS FOR EXPANDING TOBACCO WITH WATER

It has been the objective of numerous workers to find methods of expanding tobacco to increase its bulk density, or filling power. The increase in filling power permits the manufacture of cigarettes with less tobacco content, and therefore less nicotine and tar, without sacrificing cigarette size or firmness. Such methods often utilize a propellant, or expanding agent, with which the tobacco is impreganted and which subsequently generates pressure inside the cells of the tobacco, by means of a phase change from the liquid or solid state to a gaseous state.

Water is used as an expanding agent in some processes, such as that described in U.S. Pat. No. 3,765,425, which relates to the use of microwave energy to effect the phase change. Other processes employ convection heating of moistened tobacco by a hot gas, to the same end. Where convection heating is used and it is desired to achieve maximum expansion, the heating typically takes place in a high speed transport dryer to provide turbulence and high heat transfer rates. In all such processes, the tobacco is dried by the same conditions that lead to expansion, and expansion with ordinary water and heat has typically been limited to an increase of 50% or less in bulk volume.

Freeze drying processes as described in U.S. Pat. No. 3,704,716 and U.S. Pat. No. 4,271,852 also utilize water, but in a different fashion. A very large quantity of water, exceeding the weight of the tobacco being expanded, is used to saturate and swell the tobacco, which is then frozen and freeze dried in the swollen condition. Increases in filling power exceeding 80% have been reported. Despite the attractive expansion performance such processes have not gained wide commercial acceptance, due in part to the expensive equipment required and their high operating costs. Also, where freeze drying is conducted in a vacuum, the process is inherently discontinuous and requires a long cycle time. U.S. Pat. No. 3,982,550 relates to a method of impregnating tobacco with 50% or more chilled water by weight, and the impregnation is performed in a vacuum of at least 15 inches of mercury. Following impregnation, the tobacco is frozen to a precise subzero temperature under vacuum, and then is rapidly heated to effect the expansion. Excellent expansion performance is reported, but the process has not met commercial acceptance.

Two processed that yield a high degree of expansion have found significant commercial acceptance, and neither of them uses water. One uses freon, which is applied to the tobacco as a liquid. The other employs carbon dioxide, which is applied to the tobacco as a liquid under pressure and then, upon the release of pressure, is converted to dry ice. In both cases, heat is then applied to convert the expanding agent to a gas. In both cases, heat is applied in a transport dryer to achieve a high rate of heat transfer, since that leads to a high rate of gas formation and therefore high expansion.

It is an objective of the present invention to provide a method of achieving high expansion using water as the expanding agent, but which requires no addition of water beyond that which is generally present in the tobacco as it is cut for cigarette manufacture, 20% to 25% by weight.

It is a further objective of the present invention to provide a method and associated apparatus which are relatively simple, to construct and to operate, and low in cost.

It is still a further objective of the invention to provide a method and associated apparatus which are operable as a continuous process, rather than in batches.

And it is yet a further objective to provide a method and associated apparatus which performs the expansion with a minimum loss of moisture during processing, as such moisture loss is often associated with a degree of loss of tobacco components and flavors.

SUMMARY OF THE INVENTION

This disclosure relates to a process for expanding tobacco in which, (1) the tobacco is provided for processing with a moisture content exceeding that normally present in manufactured tobacco products, (2) the tobacco may be frozen, depending on the fineness of control available in the subsequent heating step, and (3) the tobacco is rapidly heated to vaporize a portion of its water content and effect the expansion.

Step (1) preferably comprises the use of tobacco immediately after it is cut, when it has a moisture content of 20% to 25%.

Step (2) preferably comprises contacting the tobacco with a spray of liquid nitrogen or liquid carbon dioxide, or a bath of liquid nitrogen, or a stream of chilled air, to deep freeze the tobacco to a predetermined temperature.

Step (3) preferably comprises heating the tobacco very rapidly in a high speed stream of gas at a temperature of at least 400° F., containing at least 50% steam. Step (3) may be conducted in a transport dryer, but is preferably conducted in a high speed downdraft belt dryer with a porous belt, low bed depth and short residence time.

DETAILED DESCRIPTION OF THE INVENTION

The requirements for high expansion by a propellant expanding agent are that gas be generated very rapidly within the tobacco cells, and that the tobacco be expandable. Conceptually there is no reason why water should be a less effective expanding agent than freon or carbon dioxide, for example. However, freon boils at a temperature below 0° F. and carbon dioxide, or dry ice as used in the commercial process, sublimates at −110° F. Water boils at about 212° F., so the temperature at which expansion takes place with water is substantially higher than that at which the expansion takes place with the other agents. The latent heat of vaporization of water is also substantially higher than that of, for example, freon, so the rate of heat transfer must be higher to achieve equivalent vapor formation and expansion. This leads to two obstacles.

First, it is difficult to apply heat very rapidly to the tobacco, which typically implies the use of a very hot gas, when the tobacco itself is about 200° F., without overheating the tobacco and degrading its properties. If the heating takes place in air, or if excessive oxygen is present, the tobacco may char or burn. If residence time in the heater is too long or poorly controlled, the tobacco will become excessively dry even in an inert atmosphere.

Second, the surface of moistened tobacco will become dry before reaching the expansion temperature of about 200° F., and once dry it will become less flexible and therefore less expandable.

The present invention relates to means of overcoming those obstacle to obtain high expansion and a quality tobacco product with water as the expanding agent.

In accordance with the present invention, tobacco is preferably provided in cut form with a mositure content of 20% to 25% O.V. The tobacco may then be frozen, as with a spray of liquid nitrogen or carbon dioxide, which provides two benefits. First, if it is difficult to precisely control residence time of the tobacco in the subsequent heating step, the low initial temperature of the tobacco on entering the heater, and the heat of fusion of water to be overcome in the heating, add a margin of safety to prevent overheating. Second, the prior freezing will leave the interior of the tobacco particle somewhat cooler than its surface even after the heating step, which will minimize the loss of moisture and tobacco components during expansion.

Freezing is therefore not a necessary step, but may be preferable, particularly if the subsequent intense heat application is not well controlled.

Moistened or moistened and frozen tobacco is then brought to a heating zone in which high speed gas used for heating should have temperature at least 300° F. and a steam dewpoint of at least 180° F. The high dewpoint prevents any drying of the tobacco from taking place while the tobacco is being heated up to the dewpoint temperature. Instead of the particle becoming dry and rigid, moisture condenses on it and enhances its flexibility as long as it is below the dewpoint temperature, which should preferably be as high as is practical.

Mechanically, the heating preferably takes place on a porous belt conveyer with a downdraft hot gas stream having at least 30 ft/sec gas velocity. This insures a very high heat transfer rate to the tobacco and a controllable residence time, preferably 3 seconds or less.

The invention can also be practiced with a transport dryer, which is mechanically simpler but less consistent thermally. Average relative velocity between the gas and tobacco particles is lower in a transport dryer, so the heat transfer coefficient is lower, and the gas stream must be hotter to compensate. Also, tobacco residence time in a transport dryer is less well defined due to the use of a cyclone or similar separator to extract the particle from the gas stream after heating.

The present invention has been found to increase the filling power of cut tobacco from about 4.4–5.6 cc/g to about 8.0–9.2 cc/g. In all tests, tobacco processed was initially at 20% to 25% moisture content, and the relative velocity between the hot gas and the tobacco particles was maintained at about 50 ft/sec throughout the heating period by means of downdraft gas flow through a 50 mesh screen on which the tobacco was held. In measuring filling power, one or more samples of expanded tobacco, and an unexpanded control, were allowed to reach moisture equilibrium with the ambient atmosphere. Then a 2.5 g sample of each was placed in a 100 cc graduate and compressed under a piston at a pressure of about 2.7 psi, and allowed to settle for 15 minutes before a measurement of its volume was taken.

The exit O.V., or moisture level of the tobacco immediately after expansion, was measured by comparing the weight of the sample at exit to its weight after being remoistened to approximately 11% O.V.

The following examples are illustrative:

EXAMPLE 1

A sample of cut bright tobacco was placed on a 50 mesh screen to a bed depth of $\frac{1}{8}$–$\frac{1}{4}$ inch. The sample was exposed for about 1.5 seconds to a 600° F. gas stream with approximately 50% steam content, or 180° F. dewpoint. A control sample of the same tobacco was set aside for later comparison. After processing and weighing, the sample was allowed to equilibrate overnight to ambient moisture, alongside the control. Exit O.V. of the expanded sample was 8.5%, and its filling power was 8 cc/g. Filling power of the control was 4.4 cc/g.

EXAMPLE 2

Two samples were expanded and a control set aside. One sample was frozen with a spray of liquid nitrogen and heated by 500° F. gas with 180° F. dewpoint for about 2 seconds. Its filling power after treatment was 9.2 cc/g, and its exit O.V. was 12%. The second sample was not frozen, and was exposed to 600° F. gas with the same dewpoint for about 1 second. Its filling power was also 9.2 cc/g, but its exit O.V. was only 10%. The control sample had filling power of 5.2 cc/g.

EXAMPLE 3

Two sample were expanded and a control set aside. Both samples were heated in 500° F. gas consisting primarily of heated air without added moisture. One sample was frozen with liquid nitrogen and then heated for about 2 seconds. Its filling power after equilibration was 8 cc/g and its exit O.V. was 15%. The other sample was not frozen, and was heated for about $1\frac{1}{2}$ seconds. After equilibration its filling power was also 8 cc/g, but its exit O.V. was only 8%. The control filling power was 5.6 cc/g.

What is claimed is:

1. A method for expanding tobacco in which tobacco containing at least 15% moisture by weight is heated by a stream of gas, the temperature of said gas being from about 300° F. to about 800° F., such that relative velocity between said gas and said tobacco particles is from about 15 ft/sec to about 150 ft/sec, over substantially the entire residence of the tobacco in said gas stream.

2. The method of claim 1 wherein said tobacco is exposed to said gas stream for a period of about 0.5 to about 6.0 seconds.

3. the method of claim 2 wherein said tobacco is exposed to said gas stream for a period of about 0.5 to 0.6 seconds.

4. The method of claim 2 wherein said gas includes steam with a dewpoint of at least 180° F.

5. The method of claim 1 wherein said gas includes steam with a dewpoint of at least 180° F.

6. The method of claim 1 wherein said tobacco contains between 15% and 25% moisture by weight.

7. The method of claim 1 wherein said stream of gas has non-turbulant flow.

8. The method of claim 1 wherein said method is carried out at atmospheric pressure.

9. A method for expanding tobacco in which tobacco containing at least 15% moisture by weight is frozen to below 30° F. at approximately atmospheric pressure, and then is rapidly heated by a stream of gas, the temperature of said gas being from about 300° F. to about 800° F.

10. The method of claim 9 wherein said tobacco contains between 15% and 25% moisture by weight.

11. The method of claim 9 wherein said method is carried out at atmospheric pressure.

* * * * *